United States Patent [19]

Mallek et al.

[11] 4,184,437

[45] Jan. 22, 1980

[54] FURNACE FOR WASTE MATERIAL

[75] Inventors: Heinz Mallek; Werner Jablonski, both of Linnich, Tetz, Fed. Rep. of Germany

[73] Assignee: Kernforschungsanlage Jülich Gesellschaft mit beschränkter Haftung, Jülich, Fed. Rep. of Germany

[21] Appl. No.: 930,516

[22] Filed: Aug. 3, 1978

[30] Foreign Application Priority Data

Aug. 4, 1977 [DE] Fed. Rep. of Germany ..... 2735107

[51] Int. Cl.[2] ..... F23G 5/12

[52] U.S. Cl. ..... 110/251; 110/258; 110/297

[58] Field of Search ..... 110/247, 248, 251, 258, 110/278, 297

[56] References Cited

U.S. PATENT DOCUMENTS

| | | | |
|---|---|---|---|
| 1,724,352 | 8/1929 | Ilving | 110/247 |
| 2,402,436 | 6/1946 | Nichols | 110/247 |
| 4,048,927 | 9/1977 | Mallek et al. | 110/251 X |
| 4,116,136 | 9/1978 | Mallek et al. | 110/251 |

*Primary Examiner*—Edward G. Favors
*Attorney, Agent, or Firm*—Becker & Becker, Inc.

[57] ABSTRACT

A furnace for waste material. The furnace has a central chute for receiving the waste material, and a combustion chamber which is arranged below the chute and has a closed bottom. The transition between the central chute and the combustion chamber is designed as a constriction in such a way that the waste material remains above the constriction in the central chute for drying and degasification up to the point of combustion. Essentially, only ashes pass through the constriction downwardly into the combustion chamber. The gases which are withdrawn downwardly out of the chute are also guided through the constriction into the combustion chamber. Fresh air supply lines discharge at the constriction and in the lower portion of the chute above the constriction. The flue gases formed in the combustion chamber are guided to a flue through discharge openings in the exhaust chamber of the combustion chamber. The exhaust chamber is designed in such a way that it surrounds the central chute. A device is provided in the chute for stirring the waste material. A guide arrangement is provided below the transition area between the central chute and the combustion chamber. Starting from this transition area, the guide arrangement is formed as an intermediate wall in such a way that the combustion chamber is divided into an inwardly lying step-down flow portion, and an outwardly lying chamber which at the same time forms the lower portion of the exhaust chamber. Further fresh air supply lines discharge in the region of the lower portion of the exhaust chamber.

3 Claims, 1 Drawing Figure

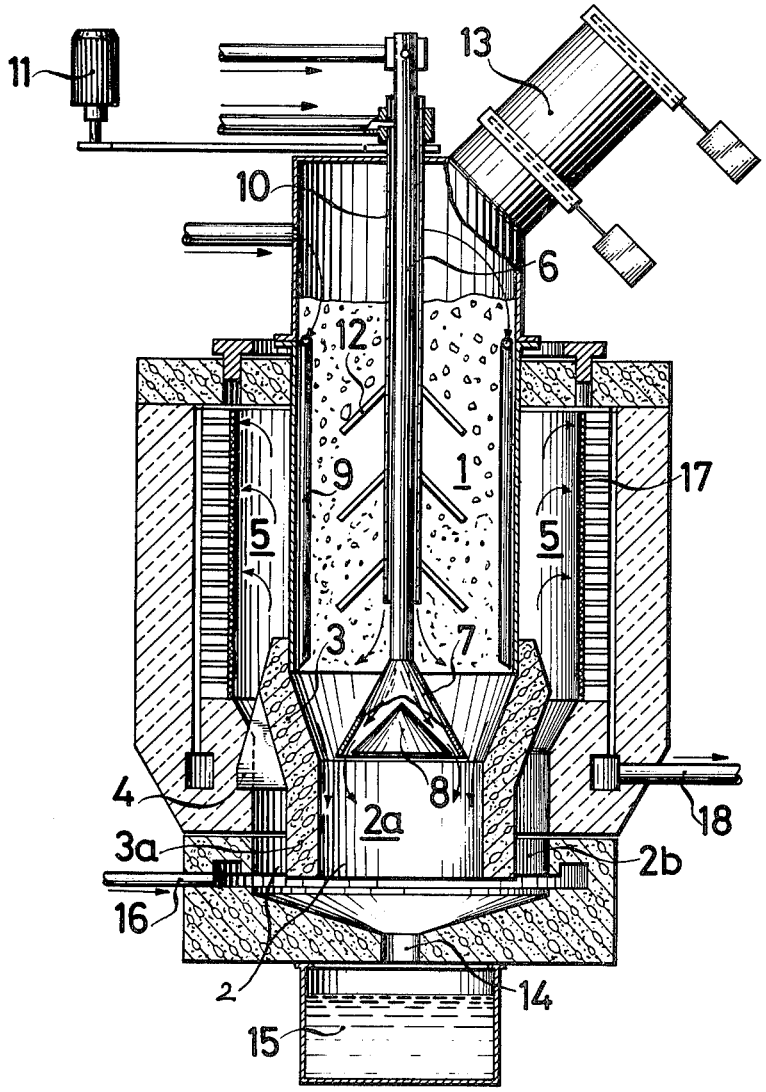
11
13
10
6
12
9
1
17
5
5
3
7
4
8
2a
18
3a
2b
16
2
14
15

FURNACE FOR WASTE MATERIAL

The present invention relates to a furnace for waste material, and starts from assignee's allowed patent application Ser. No. 764,915, U.S. Pat. No. 4,116,136. The furnace has a central chute for receiving the waste material, and a combustion chamber which is arranged below the chute and has a closed bottom. The transition between the central chute and the combustion chamber is designed as a constriction in such a way that the waste material remains above the constriction in the central chute for drying and degasification up to the point of combustion. Essentially, only ashes pass through the constriction downwardly into the combustion chamber. The gases which are withdrawn downwardly out of the chute are also guided through the constriction into the combustion chamber. Fresh air supply lines discharge at the constriction and in the lower portion of the chute above the constriction. The flue gases formed in the combustion chamber are guided to a flue through discharge openings in the exhaust chamber of the combustion chamber. The exhaust chamber is designed in such a way that it surrounds the central chute. A device is provided in the chute for stirring the waste material.

Great Britain Pat. No. 1365125 discloses a furnace for waste material, and has a central chute for receiving waste material and a combustion chamber which is arranged below the chute and has a closed bottom. The combustion chamber is provided with fresh air supply lines located in that portion of the combustion chamber which is directly connected to the chute. With this known furnace, the transition between the central chute and the combustion chamber is designed as a constriction, and the flue gases formed in the combustion chamber are guided through the discharge openings in the exhaust chamber of the combustion chamber to a flue. A grid element is located at the transition area between the central chute and the combustion chamber. With regard to the waste material, the arrangement of the grid element at the transition area forms a constriction, so that above the grid element the waste material is accumulated, and starting from the grid element, the waste material discharges into a fill. With regard to the gases with this known furnace, however, no constriction is formed, since the grid element is permeable to the gases.

This known furnace is provided for practicing a method according to which the waste material is accumulated in the central chute, is dried and degasified by heating, and the exhaust gases formed during the drying and degasification are burned in the combustion chamber amid the supply of fresh air. In this way, not only is the fresh air which is guided from below through the grid element, but also the fresh air which is introduced above the constriction into the chute, are guided upwardly into the waste column. The exhaust gases formed in the waste column are withdrawn upwardly and are supplied to separate devices for processing the exhaust gases. With this form of the known furnace, however, it is not possible to control the combustion of the waste material in such a way that the thermal energy contained in the waste material suffices for combustion of waste material of customary composition. On the contrary, it is necessary with the known device to use additional burners arranged in the wall of the combustion chamber, through which burners the foreign fuel is introduced into the combustion chamber.

By comparison, the furnace of the above mentioned patent application, for carrying out the method of that patent application, differs from the known method in that the waste material in the chute is heated under the exclusion of air, heated up air at below stoichiometric proportions is supplied ahead of the constriction to the heated up waste material and the exhaust gases formed during the heating of the waste material, the exhaust gases are withdrawn downwardly through the constriction, and further fresh air is supplied to the exhaust gases in the degasified waste material for their common combustion in the constriction, so that essentially only ashes pass downwardly through the constriction into the combustion chamber.

With the furnace of the above mentioned patent application, the waste material is first heated under the exclusion of air in the upper part of the central chute, resulting in a drying and degasification of the waste material and thereby a thermal decomposition of the waste material. In order to achieve this in an as economical a manner as possible, with the furnace of the above mentioned patent application, the withdrawal lines for the flue gases discharge into an exhaust chamber which surrounds the central chute. The waste heat of the exothermic combustion process which takes place in the lower portion of the chute as well as in the combustion chamber, is thereby supplied over a short heat conduction route to the waste material located in the chute for carrying out the endothermic drying and degasification. Due to the fact that the exhaust gases are withdrawn downwardly, the partially burned or low temperature carbonization gases formed during the drying and degasification are also further conducted in the direction of the increasing temperature gradient. As a result, the partially burned or low temperature carbonization gases are cracked in the increasing heat to short-chained hydrocarbon molecules, which are then, in the subsequent combustion step, easily and completely burned without leaving behind tar-containing residues.

By means of the fresh air supply lines which discharge into the central chute above the constriction, fresh air is supplied to the waste material at below stoichiometric proportions. In this connection, if necessary—in the event the waste material does not contain enough moisture—, water vapor or water is supplied to the fresh air. In this way, it is possible in a simple manner to bring about the water gas reaction desired for generating combustible gases. Since, in this connection, the resulting gases are drawn downwardly through the constriction, a heat bed is formed in the region between the fresh air supply lines above the constriction and the constriction itself. In this heat bed takes place not only the exothermic combustion process but also, intensified by the exothermic process, the endothermic process of degasification, particularly however the destructive distillation of the waste material. In this way, on the one hand a reduction in volume and embrittlement of the waste material is achieved, which makes easier the access of the material to the constriction. On the other hand, the process taking place in the heat bed causes a coking of the waste material, and the material is thereby converted into a homogeneous form. Smaller pieces of coke which fall to the bottom of the combustion chamber are completely burned by means of the oxygen-containing exhaust gases which flow downwardly.

By means of the furnace of the above mentioned patent application, a uniform combustion of the waste material is achieved even with a non-uniform charge of the waste material. At the same time, in a simple and economical manner, while covering the heat requirement from the thermal content of the waste material, the temperature required for combustion of the waste material is constantly maintained.

It is an object of the present invention to further improve the furnace of the above mentioned patent application in such a way that the advantages of the furnace are maintained and additionally, a melt of the slag which remains as residue is possible.

This object and other objects and advantages of the present invention will appear more clearly from the following specification in connection with the accompanying drawing, which schematically illustrates one specific embodiment of the furnace of the present invention.

The furnace of the present invention is characterized primarily in that a guide arrangement is provided below the transition area between the central chute and the combustion chamber. Starting from this transition area, the guide arrangement is formed as an intermediate wall in such a way that the combustion chamber is divided into an inwardly lying step-down flow portion, and an outwardly lying chamber which at the same time forms the lower portion of the exhaust chamber. The furnace is further characterized in that further fresh air supply lines discharge in the region of the lower portion of the exhaust chamber.

By the fact that the combustion chamber is divided into a step-down flow portion and an outwardly lying chamber, the combustion in that portion of the combustion chamber which is surrounded by the step-down flow portion, especially however in the region of the constriction, is intensified. Therefore, temperatures of about 1500° C. can be achieved in the region of the constriction. These temperatures lead to melting of the slag. In this connection, since the hot gases are directed downwardly upon the bottom of the combustion chamber by means of the step-down flow portion, this hot temperature zone also extends to the lower portion of the combustion chamber, so that the ashes are also converted on the bottom of the combustion chamber into a melt. From there, the melt passes out of the furnace through at least one withdrawal line expediently provided in the bottom of the combustion chamber.

By means of the addition of further fresh air into the region of the lower portion of the exhaust chamber, in which the exhaust gases pass after leaving the step-down flow portion, the final combustion of the exhaust gases takes place here. In this connection, the temperature of the exhaust gases is at the same time lowered to about 1000° C. by the addition of fresh air.

A further feature of the present invention consists in that conduits, which extend from the outside into the chute and are connectable to a combustion gas supply, discharge at the constriction. Thus it is possible, in case difficult to burn waste material is also to be burned, to supply combustion gas to the constriction in order to intensify the combustion.

Referring now to the drawing in detail, a central chute 1 is provided for receiving the waste material. The combustion chamber 2 is directly connected with the chute 1. The lower portion of the central chute 1 is formed by a furnace muffle 3, the lower portion 3*a* of which projects into the combustion chamber, dividing the latter into a step-down flow portion 2*a* and an outwardly lying chamber 2*b*. The furnace muffle 3 is supported on supports 4, of which only one is shown in the drawing. The outwardly lying chamber 2*b* is connected with the exhaust chamber 5 for the flue gases. The exhaust chamber 5 is designed as an annular chamber surrounding the central chute 1.

A centrally guided pipe 6 projects into the chute 1 from above. The lower end of the pipe 6 widens into a conical portion 7 which serves to collect the waste material located in the upper and middle portions of the central chute 1. The conical portion 7 is formed in such a way that a constriction in the form of an annular gap is formed between the portion 7 and the wall of the furnace muffle 3. The cross sectional opening of this gap is such that only pieces of a predetermined particle size—ashes and pieces of coke—pass through. A cone 8 is furthermore placed in the portion 7 in such a way that it forms slots with the lower end of the portion 7. The fresh air supplied through the pipe 6 passes into the step-down flow portion 2*a* of the combustion chamber through these slots. If necessary, combustion gas can also be supplied to the constriction through the pipe 6. To supply fresh air into the waste column above the constriction, further pipes 9 are provided along the inner wall of the chute 1. A pipe 10 which is coaxial with and surrounds the pipe 6 is also provided. These pipes 9 and 10 are also connectable to an external supply of combustion gas or even to a water vapor supply line. Furthermore, the pipe 10 is rotatably mounted and is rotatable by means of a drive 11. Since rod-shaped elements 12 are attached to the pipe 10, it is possible, by turning the pipe 10, to stir the material found in the waste column, thereby changing the material over.

During the operation of the furnace, the central chute 1 is filled with waste material from a charging box 13 up to about a level which corresponds to the wavy line shown in the drawing. In the upper and middle portions of the chute 1, the waste material is dried and degassed by means of the heat which passes from the exhaust chamber 5 into the waste column. By means of the fresh air supplied through the pipes 9 and 10, in the heat bed located in the region above the constriction, a reduction in volume of the waste material takes place as a result of destructive distillation, and a reduction in size of the material takes place as a result of the embrittlement. At the constriction itself, along with the supply of fresh air through the pipe 6, the destructively distilled waste material is burned and the residue is melted. Ashes or pieces of coke falling on the bottom of the combustion chamber are burned at the bottom of the combustion chamber by the hot combustible gases which flow downwardly, and the residue is likewise melted. The melt then passes through the withdrawal conduit 14 in the bottom of the combustion chamber to a receptacle 15 which is provided for receiving the melt and is filled with water. In this connection, it is naturally also possible to form the bottom of the combustion chamber as a receptacle which can be closed off by flaps and in which the melt can be collected and saved for a certain period of time.

Further fresh air for the complete combustion of the exhaust gases is supplied to the lower portion of the combustion chamber through fresh air supply lines 16. At the same time, this fresh air achieves a cooling off of the exhaust gases. These exhaust gases are then further conducted into the exhaust chamber 5, and from there are conducted through the filter 17 to the exhaust gas line 18. Solid materials carried along in the exhaust gases as suspensions are deposited on the filters 17, and are also burned there by means of the oxygen still present in the hot gases. The filters comprise ceramic orifice plates having mats of ceramic fibers arranged on the plates in the direction of the arriving gases.

With a furnace of the above described type, waste material having a heat value of about 3000 Kcal/kg was burned. The major portion of the waste material comprised paper and synthetic material. Further constituents were moist leaves, animal carcasses, and inert materials such as cans and glass bottles. The furnace operated at a throughput of 100 kg waste material per hour. The residue was obtained as a melt.

The present invention is, of course, in no way restricted to the specific showing of the drawing, but also encompasses any modifications within the scope of the appended claims.

What is claimed is:

1. A furnace for waste material, which includes in combination: a chute for receiving said waste material, said chute having an open end; a combustion chamber arranged below said lower end and provided with a closable bottom for slag collection; a furnace muffle extending from said lower open end of said chute to said combustion chamber; first conduit means connectable to a source of fresh air and forming a constriction with said furnace muffle, said first conduit means leading to said constriction; second conduit means being connectable to a source of fresh air and being arranged in said chute and ending in said chute above said constriction for supplying fresh air thereto; flue means surrounding said chute and communicating with said combustion chamber for releasing flue gases therefrom; means arranged in said chute for aiding the movement of said waste material through said chute; a guide arrangement in the form of an intermediate wall formed from that portion of said furnace muffle located below said constriction, said intermediate wall dividing said combustion chamber into a radially inwardly lying step-down flow portion and a radially outwardly lying chamber communicating with said flue means; and third conduit means connectable to a source of fresh air and ending in said outwardly lying chamber.

2. A furnace according to claim 1, which includes a slag withdrawal conduit at the bottom of said combustion chamber.

3. A furnace according to claim 1, which includes fourth conduit means arranged in said chute, ending above said constriction, and connectable to a source of fresh air, said first, second and fourth conduit means also being selectively connectable to a source of combustion gas.

* * * * *